United States Patent [19]

Harding

[11] 4,256,233

[45] Mar. 17, 1981

[54] BLANK FOR A BOTTLE CAP

[75] Inventor: Sune Hárding, Partille, Sweden

[73] Assignee: AB Wicanders Korkfabriker, Sweden

[21] Appl. No.: 876,728

[22] Filed: Feb. 10, 1978

[30] Foreign Application Priority Data

Feb. 24, 1977 [SE] Sweden ..... 7702037

[51] Int. Cl.[3] ..... B65D 41/42

[52] U.S. Cl. ..... 215/254

[58] Field of Search ..... 215/254, 256, 255

[56] References Cited

U.S. PATENT DOCUMENTS

| | | | |
|---|---|---|---|
| 2,652,165 | 9/1953 | Wener | 215/254 |
| 3,258,149 | 6/1966 | Wheaton | 215/254 |
| 3,260,395 | 7/1966 | Ellis | 215/254 |
| 3,276,613 | 10/1966 | Bozek | 215/254 |
| 3,380,609 | 4/1968 | Potts | 215/254 |
| 3,870,184 | 3/1975 | Fuchs | 215/255 |
| 3,974,931 | 8/1976 | Moller | 215/254 |

*Primary Examiner*—Donald F. Norton

[57] ABSTRACT

A blank for forming a bottle cap is disclosed, the completed bottle cap having a tear tab cooperating with score lines extending across the top of the cap for manual removal of the cap from a bottle. Two score lines are provided which extend from the tear tab to the opposite side of the blank, the score lines being asymmetrical to facilitate the formation of a tear-off tab. The described arrangements of score lines serve to obtain an easy removal of the cap from a bottle after the tearing operation.

17 Claims, 6 Drawing Figures

Fig. 3
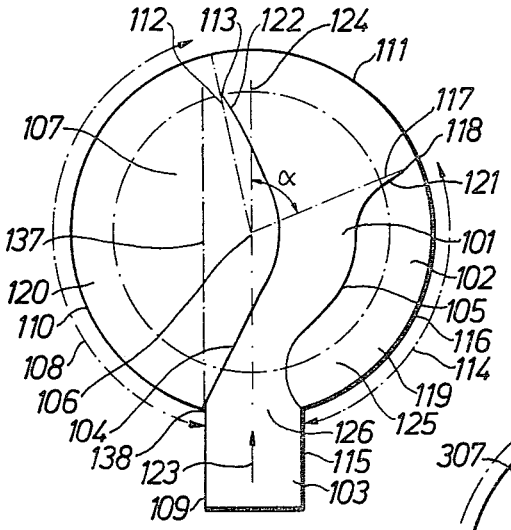
Fig. 5
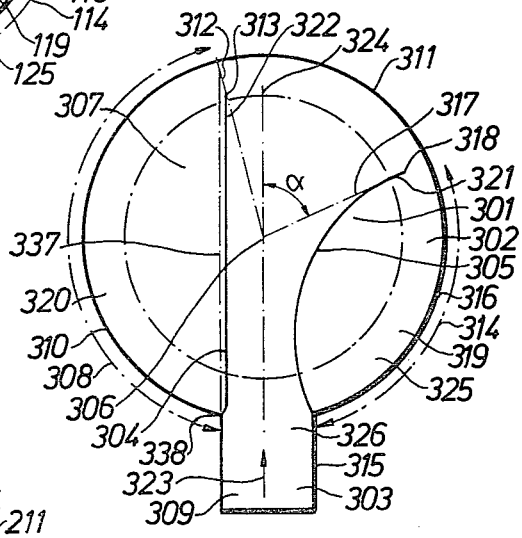
Fig. 4
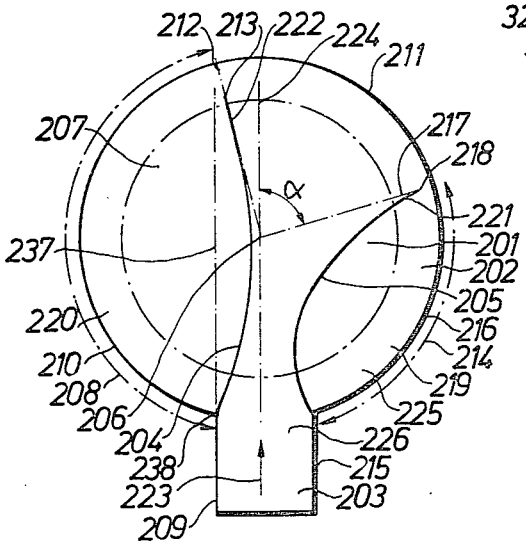
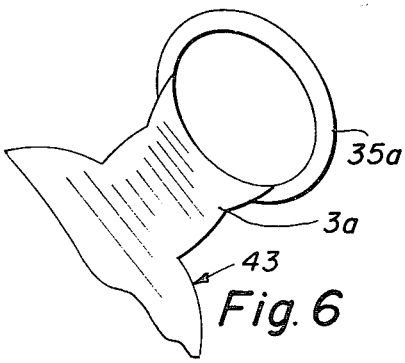
Fig. 6

BLANK FOR A BOTTLE CAP

BACKGROUND OF THE INVENTION

The present invention relates to a blank for use in forming a sealing cap for a bottle, and the invention also relates to a cap when formed from such a blank.

It has also been proposed to provide a flat blank for forming into a sealing cap for a bottle, the blank comprising an inner circular upper cap part, and an annular peripheral side part surrounding the upper cap part, and an element intended to provide a tear-off means which extends radially outwardly from the side part of the cap, there being a pair of score lines formed in the material of the blank which extend from the vicinity of the tear-off means to positions on the opposite side of a central point of the blank.

One blank of this type is described in Swedish Pat. No. 216,716. In this known cap blank the annular peripheral side part of the cap is provided at the sides of the tear-off means, which are in the form of a tear-flap, with a pair of softly rounded recesses. The score lines, which are arcuate, extend symmetrically in the direction of the axis of the tear-flap from the vicinity of the tear-flap to points on the opposite side of the central region of the blank. The score lines start just inside but slightly away from the said recesses. Initially the score lines converge but the convergence decreases towards the central region of the blank and subsequently the score lines diverge. It is to be appreciated that the central region of the blank is a common central region for the inner circular upper cap part and the surrounding annular peripheral side part of the cap.

The flat cap blank described in Swedish Pat. No. 216,716 may be converted into a cap for a bottle by means of a deep drawing operation. The flat peripheral region of the cap is then reshaped to form a cylindrical side or skirt of the finished cap. During the deep drawing operation the material at the periphery of the flat blank cap will be displaced inwards to the smaller diameter of the cylindrical region of the finished cap. Thus, if the score lines did run parallel in this side region of the cap they would be subjected to deforming lateral forces during the deep drawing operation which would cause wear, uncontrolled alteration of shape, and even rupture of the score lines, and thus the cap would be difficult to remove from the mouth of the bottle or other container. This problem has been appreciated, but no final solution to the problem has yet been proposed.

When a cap manufactured from a blank as described above is mounted on a bottle the cap firmly engages the peripheral rib provided at the mouth of the neck of the bottle. When the bottle is to be opened the tear-flap is pulled, and two symmetrical side segments are formed which tend to maintain what might be termed as "claw-grip" upon the neck of the bottle. In order to remove the cap the tear-flap must be pulled so hard during the opening process that the peripheral rib provided at the mouth of the bottle deforms the two segments of the cap sufficiently to enable them to release their claw-grip around that rib. It has been found that the present caps, when used on beer bottles and the like, may be difficult to remove, especially when dried beer etc. forms between the glass and the cap and acts as an adhesive. The above described design of score lines causes an inwardly directed lateral force to be generated during the tearing process, thus tending to increase the claw-grip of the cap on the bottle.

OBJECTS OF THE INVENTION

One object of the present invention is to provide a flat cap blank which may be used to form a bottle cap by a deep drawing process, the cap being easier to remove manually from the bottle than the above described prior proposed cap.

Another object of this invention is to provide an improved bottle cap.

BRIEF SUMMARY OF THE INVENTION

According to this invention there is provided a blank for forming a sealing cap, said blank comprising a flat sheet of metal defining an inner circular upper cap part and an annular peripheral side part surrounding the upper part, and an element constituting tear-off means extending radially outwardly from the said side part of the cap, there being two score lines or other lines of mechanical weakness in the material forming the blank, the score lines extending from the vicinity of the tear-off means to positions on the opposite side of a central point of the blank, the score lines being asymmetrical and terminating in regions adjacent the edge of the blank, the arrangement being such that the distance clockwise from one side edge of the flap along the first part of the outer peripheral edge of the side part of the blank to a first radius extending from the central point of the blank through the end point of a first one of the score lines is substantially different from the distance counter clockwise from the other side edge of the tear-off means along a second part of the outer peripheral edge of the side part of the blank to a second radius extending from the central point through the end point of the second score line.

This invention also relates to a cap formed from such a blank, especially a cap formed by a deep drawing process in which said annular peripheral side part is deformed to have a substantially cylindrical configuration. The invention also relates to a bottle provided with such a cap.

The asymmetrical positioning of the score lines results in side segments which are not symmetrical, one being shorter than the other, so that the segments are more easily released from their claw-grip around the rib provided at the mouth of the bottle.

Preferably the terminal regions of the score lines are substantially radially oriented in the side part cap, and thus undesired alterations of shape are avoided during the deep drawing process and during the process of applying the cap to the bottle. Furthermore, the score lines in the rear half of the inner circular upper cap part will preferably converge towards each other thus producing outwardly directed lateral forces during the tearing process, these forces acting especially on the longer of the two side segments defined by the score lines and endeavouring to spread the two segments and release their claw-grip on the rib provided at the mouth of the bottle, so that the cap can easily be removed from the bottle.

In order that the invention may be more readily understood and so that further features thereof may be appreciated the invention will now be described by way of example with reference to the accompanying drawings.

BRIEF DESCRIPTION OF THE DRAWINGS

In the accompanying drawings

FIG. 3 is a view similar to FIG. 1 showing a further embodiment of the invention;

FIG. 4 is a further view similar to FIG. 1 showing another alternative embodiment of the invention;

FIG. 5 is another view similar to FIG. 1 showing yet another embodiment of the invention;

FIG. 6 is a perspective view of the cap similar to that shown in FIGS. 1 and 2, having a ring tear-off member.

DETAILED DESCRIPTION OF PREFERRED EMBODIMENTS

Figure 1:
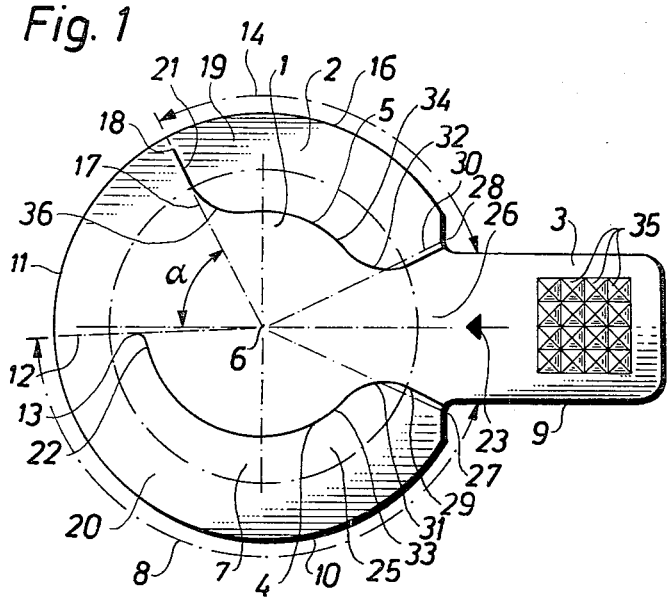
FIG. 1 is a top plan view of a flat blank for forming a cap in accordance with the present invention.
Figure 2:
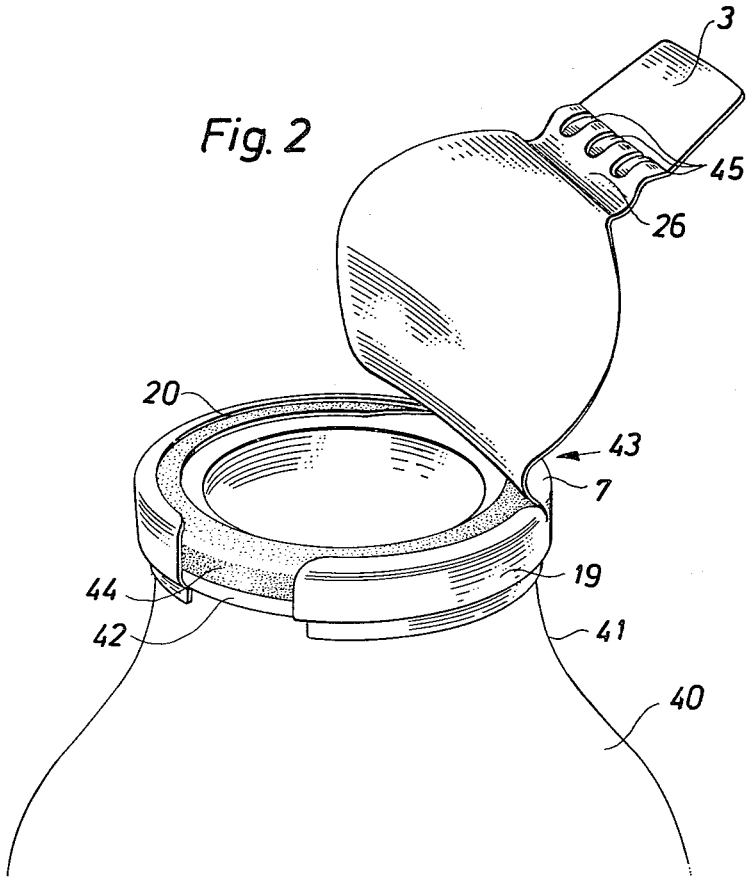
FIG. 2 is a perspective view of a sealing cap formed from the flat blank illustrated in FIG. 1, the sealing cap being applied to the mouth of a bottle and being illustrated in the process of being removed from the mouth of the bottle.

Referring to FIGS. 1 and 2 a flat blank is illustrated in FIG. 1, this flat blank being formed of thin metal sheet, such as aluminium. The blank comprises an inner circular part 1 which is intended to form the upper part of the cap, and an annular peripheral side part 2, which surrounds the upper cap part 1, this peripheral part being intended to form a cylindrical peripheral side of the cap when the blank is deformed by a deep drawing process. The blank also comprises a radially protruding element 3 which is intended to constitute a tear-off flap, this element 3 extending radially outwardly from the annular peripheral side part 2 of the blank. A pair of score lines 4 and 5, or other lines of mechanical weakness, are formed in the material constituting the blank, these lines extending from the vicinity of the sides of the flap 3, across the upper cap part 1 to positions which are remote from the flap 3. The score lines 4 and 5 are not symmetrical and extend, from positions adjacent the edge of the flap 3, past the central point 6 of the blank and across the rear half 7 of the blank, the score lines terminating adjacent the edge of the blank at positions which are selected so that the distance 8 clockwise from one side edge 9 of the flap 3 along a first part 10 of the outer peripheral edge 11 of the blank to the point where a first radius 12 extending from the central point 6 of the blank through an end point 13 of the score line 4 is much greater than the distance 14 clockwise from the other side edge 15 of the tear-flap 3 along a second part 16 of the outer peripheral edge 11 of the blank to a second radius 17 which extends from central point 6 of the blank through the end point 18 of the second score line 5.

As will be appreciated from FIGS. 1 and 2 of the accompanying drawings the score line 5 is shorter than the score line 4 and is thus associated with the shorter peripheral distance 14. Thus the score line 5 defines a sector of the blank which will become a shorter side segment 19 (see FIG. 2) during a tearing operation used to remove a cap formed from the blank from a bottle. The longer score line 4 is associated with the longer peripheral distance 8 and the longer score line 4 defines a sector of the blank which will become a longer side segment 20 (see FIG. 2) during an operation in which the blank is torn from the neck of a bottle.

From FIGS. 1 and 2 of the accompanying drawings it will also be appreciated that the score line 5 terminates in the annular peripheral side part 2 of the cap at a point adjacent the edge of the blank, whereas the other longer score line 4 terminates in the inner circular upper cap part 1. Also it will be appreciated that the shorter score line 5 has a terminal region 21 which extends substantially radially outwardly away from the central point 6 of the blank, whereas the longer score line 4 has a terminal section which is arcuate and is thus at a substantially constant distance from the central point 6. Furthermore, the terminal section 21 of the shorter score line 5 forms an angle $\alpha$ of approximately one radian with the axis 23 of the flap 3, whereas the other longer score line 4 terminates in the vicinity of the radius 12 which is substantially aligned with the axis 23 of the flap 3, the aligned axis 23 and radius 12 being coincident at the central point 6 of the blank. Thus, from a consideration of FIG. 1 and a consideration of the above description it will be appreciated that whilst the score lines 4 and 5 are symmetrical in the front half of the blank 25, (i.e. the half of the blank closest to flap 3) in the rear half of the blank 7 the score lines 4 and 5 are not symmetrical.

Part of the periphery of the cap is cut away adjacent the base 26 of the flap 3 so that the periphery of the cap extends substantially perpendicularly to the side edges of the flap 3 at the base thereof. Thus part of the periphery of the cap is defined by a chord which extends perpendicularly to the axis 23 of the flap 3. The junction between the sides of the flap 3 and the chord are rounded as at 27, 28, and the score lines 4 and 5 extend substantially radially inwardly directly from these rounded portions 27, 28. Thus the score lines initially converge. As shown in FIG. 1 the converging initial parts of the score lines 4 and 5 are located inside connection lines 29 and 30 which extend between the central point 6 of the blank and the centre of each radius of the rounded parts 27 and 28.

As mentioned above, the score lines 4 and 5 initially converge, but in a region adjacent the junction between the side part 2 and the inner circular upper part of the cap the score lines 4 and 5 diverge, following first diverging circular arcs 31 and 32 respectively. Subsequently the score lines 4 and 5 follow circular arcs 33 and 34 which have a common radius of curvature and a common centre of curvature which substantially coincides with the central point 6 of the blank. These arcuate portions 33, 34 of score lines 4 and 5 comprise most of the length of the score line which lies on the upper cap part 1. It is to be appreciated that the distance between the score lines 4 and 5 is least in the region of the score lines defined by the arcs 31 and 32, this distance being less than the width of the flap 3 at its base 26.

The flap 3 may be the same width over its entire length, but in the embodiment illustrated in FIGS. 1 and 2 it is somewhat broader at the base 26 than at the free end thereof. Furthermore, in the embodiment illustrated flap 3 is a substantially rectangular flap which is provided at its free end with punch marks or other embossed marks to give a better grip, the punch marks being illustrated as a square array of square pyramids 35 comprising four rows and four columns. It is to be appreciated that the flap 3 may be modified in many ways, and indeed the flap 3 may be constituted as a ring rather than merely by a substantially rectangular flap.

In the rear half 7 of the blank 5 the short score line 5 terminates with an outwardly directed circular arc 36 which ends in a radially outwardly directed portion 21. However, the longer score line 4 follows the arc 33 almost to its end 13. The arcs 31, 32 and 36 preferably have the same radius of curvature, whilst the arcs 33 and 34 have a larger radius of curvature. For a blank to form a cap for a bottle having a mouth with an external diameter about 26.6 mm the arcs 31, 32 and 36 may have a radius of curvature of about 6 mm and the arcs 33 and 34 may have a radius of curvature of about 10 mm. The shortest distance from the end of the score line 5 to the arc 36 is greater than the shortest distance between the arcs 31 and 32 and preferably at least as great as the width of the flap 3 at its base 26.

FIG. 2 illustrates a bottle 40 having a neck 41 and a radially extending rim at the mouth of the neck. On the rim 42 is a cap 43 which is illustrated, in FIG. 2, in the final stage of being pulled off the bottle 40. The cap 43 has been formed by deforming the flat cap blank as illustrated in FIG. 1, and as described above, by means of a drawing operation, the resultant cap being substantially dome-shaped and having a flat upper part and a cylindrical side wall extending downwardly from the flat upper part. The dome-shaped cap is then applied to the opening of a bottle and subsequently caused to embrace the lower edge of the rib 42 by deforming the lower periphery of the side part of the cap with sealing jaws or the like (not shown).

Before the blank is applied to a bottle to form a cap the blank is provided with a sealing insert which is secured to the blank with the aid of an adhesive varnish or the like. The sealing insert which may, if desired, cover the entire lower surface of the cap in order to provide dust free resealing of an opened bottle, consists in the preferred embodiment illustrated in the accompanying drawings, of a ring seal 44. The ring seal covers the score lines 4 and 5 where they run concentrically with the periphery of the cap and protects the score lines from contact with fluid contained within the bottle which might initiate corrosion. However, it is to be appreciated that the score lines may be provided on that part of the flat blank which, in the finished cap, forms the outside of the cap.

When using the adhesive varnish care should be taken that the varnish does not cover any part of the score lines 4 and 5, as otherwise the tearing process might be made more difficult or even prevented. However, if for some reason a tear stop is desired, the varnish may of course be caused to cover some suitable part of one or both score lines. In the preferred embodiment shown the ring seal 44 is only attached to the blank in the rear half 7 of the blank and in such a way that, even after the cap has been torn very far, the cap is held together in one piece.

To facilitate opening the bottle the cap 43 should be pulled backwards and upwards at an angle of about 30°–45° to the longitudinal axis of the bottle, as in the case of caps with symmetrical score lines. The shorter side segment 19 and the longer side segment 20 illustrates in FIG. 2 embrace the neck of a bottle in what may be termed a "claw-grip" and manoeuvring the cap in the manner described above will cause this claw-grip readily to be released.

The tear-flap 3 is provided at its base with one or more stiffening ridges 45 or similar folds which extend in the longitudinal direction of the flap, and which serve to reduce the material stresses at the rounded cuts 27 and 28 when a flat blank is deep drawn into the dome shaped cap blank. When the flap 3 is pulled obliquely upwards and backwards, the resultant force will be concentrated at the end of the shortest score line 5 and the side segments 19 and 20 will be broken apart there so that they release their claw-grip on the rib 42 provided at the neck of the bottle. At the same time the sealing ring 44 is torn at the end of the long score line 4 which, if desired, may start to turn slightly inwards at the end.

It will be appreciated that a cap formed from a blank as described above may readily be affixed to a bottle, and may readily be removed from the bottle, the difference in size between the segments 19 and 20 assisting in the ready release of the claw-grip.

FIGS. 3, 4 and 5 each illustrate a further flat blank intended to be shaped into a sealing cap and each of these flat blanks consists of a thin sheet of light metal, preferably aluminium. Each of the illustrated blanks comprises an inner circular upper cap part 101, 201, and 301 respectively, and an annular peripheral side part 102, 202 and 302 respectively, surrounding the corresponding upper cap part. Each blank is provided with an element 103, 203 or 303 intended to form a tear-off flap, these elements extending radially outwardly from the annular peripheral side part. A pair of score lines 104, 105; 204, 205; 304, 305; respectively are formed in the material constituting the blank and extend side by side in the vicinity of the flap 103, 203, or 303 to positions on the opposite side of the central point 106, 206, 306 of the blank. The score lines extend into the rear half 107, 207, 307, of the flat blank in relation to the flap in such a way that the distance 108, 208, 308 clockwise from one side edge 109, 209, 309 of the flap 103, 203, 303 along a first section 110, 210, 310, of the outer periphery 111, 211, 311, of the side part of the blank to a first radius 112, 212, 312 extending from the central point through the end point 113, 213, 313 of the score line 104, 204, 304, differs substantially from the distance 114, 214, 314 from the other side edge 115, 215, 315 of the flap along a second section 116, 216, 316 of the outer periphery of the side part of the blank to a second radius 117, 217, 317 extending from the central point of the blank through the end point 118, 218, 318 of the score line 105, 205, 305.

In the embodiments illustrated in FIGS. 3, 4 and 5 the score line 105, 205, 305 is shorter than the score line 104, 204, 304 and is associated with the shorter distance 114, 214, 314, thus defining what will become a shorter side segment 119,219,319, during a tearing operation of a resultant cap. Correspondingly the longer score line 104, 204, 304, is associated with the longer distance 108, 208, 308 and defines what will become a longer side segment 120, 220, 320 during the tearing operation. Furthermore, not only the shorter score line 105, 205, 305 but also the longer score line 104, 204, 304 terminates in the side part 102, 202, 302, of the cap, preferably at a slight distance from the edge of the blank. The shorter score line 105, 205, 305 has a terminal section 121, 221, 321, extending substantially radially outwardly in relation to the central point 106, 206, 306, of the blank, and the longer score line 104, 204, 304, has a terminal section 122, 222, 322. As can be seen in FIGS. 3 and 4, the terminal sections 122 and 222, extend substantially radially outwardly in relation to the central point, whereas as can be seen from FIG. 5 the terminal section 322 extends substantially parallel to axis 323 of the tear-flap. The terminal section 121, 221, 321, of the shorter score line forms an angle $\alpha$ of approximately 1 radian with the axis 123, 223, 323, of the tear-flap. On the other hand, the longer score line 104, 204, 304 terminates in a region defined laterally by a first line 124, 224, 324, coincident with the axis 123, 223, 323, of the flap and which extends through the central point 106, 206, 306, and a second line 137, 227, 327, parallel thereto but extending through the second longer score lines starting point 138, 238, 338, at the base 126, 226, 326, of the flap 103, 203, 303.

In the rear half 107, 207, 307, of each blank the score lines 104, 105; 204, 205; 304, 305; run asymmetrically in relation to each other as was the case with the score lines 4 and 5 in the embodiment illustrated in FIG. 1. However, in contrast to the embodiment illustrated in FIG. 1, the score lines do not run symmetrically in the front half 125, 225, 325, of each blank, but run asymmetrically also in this region between the flap and the central point of the blank. Thus, in the embodiment illustrated in FIG. 3, the score line 105 corresponds almost precisely with the score line 5 illustrated in FIG. 1, but the score line 104 extends initially straight in towards a central area surrounding the central point 106, passes around the central area 106 on the same side of the central area as the score line 105, and then curves out towards a terminal point 113 which is located in a region between the lines 124 and 137.

In the embodiment illustrated in FIG. 4 the score line 204 follows a circular arc of constant curvature but which passes in the vicinity of the central point, but on the opposite side of that central point than the line 205. The line 205 is also curved, but in its initial region is more strongly curved than the score line 204. When the score line 205 is compared with score lines 5 and 105 it is noted that the score line 205 has the same starting and terminal points and the same starting and terminal sections as the other two score lines 5 and 105.

Finally referring to the embodiment illustrated in FIG. 5, it is to be noted that the score line 305 is shaped as an arc of a circle apart from a preferably straight starting section, the radius of curvature of the arc being substantially unchanged throughout the length of the arc. With the exception of its initial section, the score line 304 is quite straight and extends across the blank between the lines 124, and 137, and is preferably parallel to these lines.

It will be appreciated that the blanks may be formed into caps with a deep drawing process as described with reference to the embodiment illustrated in FIGS. 1 and 2.

It will be appreciated from a consideration of the above description and the accompanying drawings that a flat blank in accordance with the invention may have many configurations. However, the above described embodiments all comprise a flat blank provided with two score lines and the score lines are formed and so that when a finished cap is pulled off a bottle, one of the score lines is torn open more quickly than the other so that the breaking apart of the side segment and release of the resultant claw-grip is facilitated, and so that the lifting process is more easily performed. Thus, in the blanks described above, the start and finish of the score lines are not diametrically opposite each other, but the finish of each score line is displaced along the circumference of the blank in relation to the start of that score line.

Although the embodiments of the flat blank according to the invention shown in FIGS. 3, 4 and 5, are not shown provided with rounded parts corresponding to the rounded parts 27 and 28 in the junction between the peripheral edge of the side part of the blank and the side edges of the tear-flap, it is possible for caps corresponding to as illustrated in FIGS. 3, 4 and 5 to be provided with such rounded parts. The same applies to the punch marks 35 on the tear-flap to increase the grip for fingers, and also relates to the provision of a tear ring instead of the tear-flap.

FIG. 6 illustrates the formation of a cap such as is shown in FIGS. 1 and 2, wherein the tearoff means 3*a* is provided with a ring 35*a* for ease in grasping.

I claim:

1. A blank for forming a sealing cap, said blank comprising a flat sheet of metal defining an inner circular upper cap part and an annular peripheral side part surrounding the upper part, and tear-off means extending radially outwardly from the said side part of the blank, there being two score lines in the material forming the blank, the score lines extending from the vicinity of the tear-off means to positions on the opposite side of a central part of the blank, the score lines being asymmetrical and terminating in regions adjacent the edge of the blank, the arrangement being such that the distance clockwise from one side edge of the tear-off means along the first part of the outer peripheral edge of the side part of the blank to a first radius extending from the central point of the blank through the end point of a first one of the score lines is substantially different from the distance counter clockwise from the other side edge of the tear-off means along a second part of the outer peripheral edge of the side part of the blank to a second radius extending from the central point through the end point of the second score line.

2. A blank according to claim 1 wherein the tear-off means comprises a flap.

3. A blank according to claim 1 wherein the tear-off means comprises a ring.

4. A blank according to claim 1 wherein one score line is shorter than the other.

5. A blank according to claim 4 wherein the shorter score line is associated with the shorter said peripheral distance and the longer score line is associated with the longer said peripheral distance.

6. A blank according to claim 5 wherein the score line which is associated with the said shorter distance terminates in the side part, and the other score line terminates in the inner circular upper part.

7. A blank according to claim 5 wherein the score line associated with the shorter peripheral distance has a terminal section extending substantially radially outwardly in relation to the central point of the blank, and the other score line has a terminal section which is arcuate about said central point.

8. A blank according to claim 5 wherein the score line associated with the said shorter peripheral distance has a terminal section which forms an angle of approximately 1 radian to the axis of the tear-off means, and the other score line terminates in the vicinity of a line running through the axis of the tear-off means and the central point of the blank.

9. A blank according to claim 4 in which in a region of the blank located between the central point and the tear-off means the score lines are substantially symmetrical in relation to each other and in which the score lines initially converge, the score lines then diverging on circular arcs and then continuing with further arc shaped portions, the centres of curvature of said further arc shaped portions substantially coinciding with the central point of the blank, the score line associated with the shorter peripheral distance turning outwardly along a further arc shaped portion whilst the other score line follows the appropriate said further arc shaped portion substantially to its end in the rear half of the blank in relation to the tear-off means.

10. A blank according to claim 9 wherein both score lines terminate in the side part of the blank.

11. A blank according to claim 4 wherein the score line associated with the said shorter peripheral distance has a terminal section extending substantially radially outwardly in relation to the central point and wherein the other score line has a terminal section extending substantially parallel to the axis of the tear-off means.

12. A blank according to claim 4 wherein both score lines have a terminal section extending substantially radially outwardly in relation to the central point.

13. A blank according to claim 4 wherein the score line associated with the shorter peripheral distance has a terminal section forming an angle of approximately 1 radian to the axis of the tear-off means, and wherein the other score line terminates in a region defined by a first line extending coincident with a line running through the axis of the tear-off means through the central point of the blank and a second line running parallel thereto through the starting point of the said other score line at the base of the tear-off means.

14. A blank according to claim 1 provided with a seal adapted to engage the neck of a bottle.

15. A cap formed from a blank according to any one of the preceding claims.

16. A cap according to claim 15 formed by a deep drawing process, wherein the annular peripheral side part is deformed to have a substantially cylindrical configuration.

17. A bottle provided with a cap according to claim 15.

* * * * *